US009746179B2

(12) United States Patent
Stegelitz

(10) Patent No.: US 9,746,179 B2
(45) Date of Patent: Aug. 29, 2017

(54) SYSTEM AND METHOD FOR LOW LOAD OPERATION OF COAL MILL

(71) Applicant: ALSTOM Technology Ltd, Baden (CH)

(72) Inventor: Peter Stegelitz, Bretten (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 688 days.

(21) Appl. No.: 13/835,768

(22) Filed: Mar. 15, 2013

(65) Prior Publication Data

US 2014/0261114 A1 Sep. 18, 2014

(51) Int. Cl.
*F23D 1/00* (2006.01)
*F23N 1/02* (2006.01)
(Continued)

(52) U.S. Cl.
CPC ..... *F23N 1/022* (2013.01); *F23K 1/00* (2013.01); *F23K 3/00* (2013.01); *F23K 3/02* (2013.01);
(Continued)

(58) Field of Classification Search
CPC ..... F23K 1/00; F23K 2201/103; F23K 3/00; F23K 3/02; F23K 2201/10; F23K 2201/1006; F23K 2201/501; F23K 1/04; F23C 2202/10; F23B 30/02; F23B 60/02; F23G 5/002; F23G 5/006; F23G 5/444; F23H 2900/09041; B02C 15/12; B02C 17/18; B02C 2015/002; B02C 15/00; B02C 15/001; B02C 15/007; B02C 23/32; B02C 2/04; B02C 19/0037; B02C 19/005;
(Continued)

(56) References Cited

U.S. PATENT DOCUMENTS 4,177,950 A 12/1979 Smith
4,244,529 A 1/1981 Degabriele et al.
(Continued)

FOREIGN PATENT DOCUMENTS

| | | | |
|---|---|---|---|
| CN | 102829467 | A | 12/2012 |
| CN | 102893090 | A | 1/2013 |
| DE | 557 461 | C | 8/1932 |
| DE | 100 60 749 | C1 | 7/2002 |
| EP | 2 527 735 | A1 | 11/2012 |

OTHER PUBLICATIONS

Office action issued from Chinese Patent Office dated Jan. 13, 2016 for CN Application No. 201410093372.3.

*Primary Examiner* — Jason Lau
(74) *Attorney, Agent, or Firm* — GE Global Patent Operation; Stephen G. Midgley

(57) ABSTRACT

Disclosed herein is a coal fed power generation system comprising a mill in fluid communication with a furnace; where the mill is operative to pulverize coal and to ventilate the coal; where the furnace contains more than one burner or burner nozzles; where the burner or burner nozzles are operative to receive the coal from the mill and combust it in the furnace; and a plurality of flow control devices; where at least one flow control device is in fluid communication with the mill and with the burner or burner nozzle; and where the flow control device that is in fluid communication with the mill and with the burners or burner nozzles is closed to prevent fluid communication between the mill and the furnace during the operation of the furnace.

19 Claims, 3 Drawing Sheets

(51) Int. Cl.

| | |
|---|---|
| ***F23K 1/00*** | (2006.01) |
| ***F23K 3/00*** | (2006.01) |
| ***F23K 3/02*** | (2006.01) |

(52) U.S. Cl.
CPC .... *F23C 2202/10* (2013.01); *F23K 2201/103* (2013.01)

(58) Field of Classification Search
CPC ..... B02C 19/063; B02C 23/04; B02C 23/34; B02C 25/00; B03B 5/52; B03B 9/005; B03B 1/00; B03B 5/623
USPC ..... 110/345, 347, 203–208
See application file for complete search history.

(56) References Cited

U.S. PATENT DOCUMENTS

| | | | | |
|---|---|---|---|---|
| 4,478,157 | A * | 10/1984 | Musto | F23K 1/00 110/106 |
| 5,330,110 | A * | 7/1994 | Williams | B02C 15/02 241/119 |
| 2005/0230980 | A1* | 10/2005 | Brunet | F03D 1/00 290/44 |
| 2005/0279095 | A1* | 12/2005 | Goldman | F01K 13/00 60/641.8 |
| 2007/0000416 | A1* | 1/2007 | Widmer | F23K 3/00 110/342 |

* cited by examiner

SYSTEM AND METHOD FOR LOW LOAD OPERATION OF COAL MILL

TECHNICAL FIELD

This disclosure relates to a system and a method for a low load operation of a coal mill.

BACKGROUND

Coal mills in power plants with direct firing systems for handling lignite, brown coal, hard coal and anthracite were designed for a defined coal flow range. This defined coal flow range into the power plant includes a minimum coal flow rate, below which the normal operation of the power plant would be hampered.

The FIG. 1 is a depiction of a common coal mill in a power plant 100 that uses a direct firing system for all forms of coal. The coal can be lignite, a brown coal, a hard coal or anthracite (hereinafter generically referred to as "coal"). In the FIG. 1, the coal mill comprises a beater wheel mill 102 in fluid communication with a furnace 106. Coal is charged to the mill 102 where it is dried and pulverized and then discharged to burners 110 and 112 where it is combusted in a furnace 106. Coal along with "drying and transport" gas (gas that is used to dry and transport the coal into the furnace) and gas that is used to control the temperature of the coal ("temperature control gas") as it exits the mill 102, prior to being charged into the furnace 106 via the burners 110 and 112.

The drying and transport gas along with the temperature control gas are mixed in a mixing chamber 128 prior to entering the mill 102, where they are mixed with the pulverized coal. The coal is then combusted in the furnace 106, to generate heat and flue gases. The flue gases are discharged to the outside.

There are many different types of coals and each of these types of coals are generally fed to a different type of mill in order to be comminuted and combusted in the furnace. Table 1 documents the different types of coals and mills that these coals are used in. It also details the conditions in the mills.

detailed below and then discharged to burners 110, 112 and 114 where it is combusted in a furnace 106.

The coal along with flue gas, primary air, and optionally water and/or cold gas are charged to a beater wheel mill 102 to pulverize the coal. The flue gas, the primary air, the water and the cold gas are first mixed in a mixing chamber 128 and then discharged to the beater wheel mill 102.

The beater wheel mill 102 is in fluid communication with a classifier 104, which functions to separate coal particles above a desired size from other coal particles that are transferred to the furnace 106. The coal particles above the desired size are recycled to the mill to undergo further pulverization.

In the beater wheel mill 102, the incoming coal is caught by the rapidly circulating beater plates 103 which are fixed at the perimeter of the beater wheel and comminuted by the impact of the beater plates and after that against the armored mill housing. Beater wheel mills have a ventilating effect—they transport the pulverized coal and carrier gas to the main burners 110 and 112 and the vapor burners 114 (e.g., a lignite firing system with vapor separation). During the normal operation of a coal fed power plant with a beater wheel mill, about 40% of the total gas flow (along with about 20% of the coal from the beater wheel mill) takes place through the vapor burner 114, while about 60% of the total gas flow (along with about 80% of the coal from the beater wheel mill) takes place through the main burners 110 and 112.

The coal (which has a natural moisture content of 30 wt % to 75 wt %, based on the total weight of the coal) is charged into the beater wheel mill 102 along with recycled flue gas and/or water, cold gas and primary air. The recycled flue gas is at a temperature of about 1000° C. and is used to dry the coal. The temperature of the flue gas is reduced from about 1000° C. to about 400° C. before contacting the coal in the mill by blending the flue gases by the addition of the primary air (at a temperature of about 300° C.), cold gas (at a temperature of 170° C.) and water injection to the recycled flue gases prior to contacting the coal.

The heating of the coal (by the flue gases) with the resulting evaporation of moisture from the coal results in the reduction of the gas temperature to about 120 to about 250°

TABLE 1

| | Mill Type | | | | |
|---|---|---|---|---|---|
| | Beater Wheel Mills | Beater Mills | Common Impact Mills | Bowl Mills | Ball Tube Mills |
| Mills are part of | direct firing system | | | | |
| Mill feed | more than one burner or one burner with more than one burner nozzle | | | | |
| Coal/fuel types | Anthracite, hard coal, brown coal lignite and pulverized fuels | | | | |
| Coal/fuel moisture content | 0%-80% | | | | |
| Mill Inlet Temperature | from ambient temperature upto 900° C. | | | | |
| Mill Outlet Temperature | from ambient temperature upto 250° C. | | | | |
| Drying and transport Media (gas) | Flue gas, hot air, cold air, cold gas | | | | |
| Gas temperature control media (gas) | hot air, cold air, cold gas, injection of water or steam | | | | |
| Ventilation of gas by | itself | itself, one additional fan or a combination of both | itself, one additional fan or a combination of both | additional fan | additional fan |

The FIG. 2 is another depiction of a coal mill in a power plant 100 that uses a direct firing system for coal. As with the mill of the FIG. 1, the coal mill comprises a beater wheel mill 102 in fluid communication with a furnace 106. Coal is charged to the beater wheel mill 102 where it is dried as C. as it is discharged from the mill to the classifier 104. Maintaining the temperature of the gas between about 120 to about 250° C. is useful because it reduces the possibility of damage to the mill from fire and/or explosions that occur at elevated temperatures greater than 250° C.

When the flow rate of coal into the mill is reduced in response to a lower demand for power it increases the possibility of explosion in the mill because reducing the amount of coal in the mill facilitates a reduction in the moisture content present in the mill, which prevents the proper reduction in gas temperature and coal temperature to about 120 to about 250° C.

In order to operate under lower demand for power (i.e., a reduced load demand) several different parameters can be varied. One possibility is to increase the amount of hot air, cold gas and water to the mill to compensate for the lower flow rate of the coal. Increasing the amount of hot air, cold gas and water controls the flue gas at the time it contacts the coal, which in turn facilitates controlling the temperature of the coal and gases being discharged from the mill 102 to the classifier 104 to be below 250° C.

In order to effect the changes listed above, several variables have to be accounted for. These are as follows. It is desirable for the oxygen concentration in the gas (after being discharged from the mill) to be 12 volume percent (e.g., in a wet condition) or less to prevent an explosion. The drying performance of the mill and the crushing performance are also to be taken into consideration to ensure that the appropriate amount of coal is discharged into the classifier and the furnace at the temperature of about 120 to about 250° C. The transport performance is also to be taken into consideration and this factor includes transportation without pulsation at the appropriate flow rate to the burner nozzles. The transportation rate includes a deposit free flow in the mill spiral and ducts. It is also desirable for the concentration ratio of pulverized coal to gas flow for safe ignition and combustion to lie within safe limits. Taking all of these factors into consideration, the average controlled load operation range for a beater wheel mill is between 50 to 100% of the full load operation.

With the increasing use of wind power and solar power for energy generation, there is a desire for reducing the coal flow below the prescribed minimum coal flow rate (i.e., below 50%). Wind power plants and solar power plants operate sporadically. For example, wind plants generate a large amount of power when there is a large amount of wind and solar plants generate a large amount of power when there is bright sunlight. However, this power is often generated when there is a low load on the power plant (i.e., there is no need for so much power). In order to compensate for the excess power generated by a wind power plant (or a solar power plant), it is desirable to reduce the power generated by a coal fed power plant that works in conjunction with the wind power plant and/or the solar power plant. When the power generated by the coal fed power plant is to be reduced to accommodate power generation by a wind or solar power plant, the aforementioned safe average controlled load operation range (of between 50% and 100%) is no longer sufficient.

It is therefore desirable to find new methods and devices for permitting a coal fed power plant to operate under low load conditions so that it can accommodate high power generation in cogenerating wind and/or solar power plants.

SUMMARY

Disclosed herein is a coal fed power generation system comprising a mill in fluid communication with a furnace; where the mill is operative to pulverize coal and to ventilate the coal; where the furnace contains more than one burner or burner nozzles; where the burner or burner nozzles are operative to receive the coal from the mill and combust it in the furnace; and a plurality of flow control devices; where at least one flow control device is in fluid communication with the mill and with the burner or burner nozzle; and where the flow control device that is in fluid communication with the mill and with the burners or burner nozzles is closed to prevent fluid communication between the mill and the furnace during the operation of the furnace.

Disclosed herein is a method comprising pulverizing coal in the presence of a mixture of hot flue gases; cold gas; air and water in a mill; discharging the pulverized coal and the mixture of hot flue gases; cold gas, water and air from the mill to a classifier, where the classifier is operative to separate coal particles of a given size from a remainder of the coal particles; discharging the pulverized coal and the mixture of hot flue gases; cold gas, water and air to a furnace through a plurality of flow control devices; combusting the pulverized coal in the furnace; where the furnace contains one or more vapor burners and one or more main burners; where the vapor burners and the main burners are operative to receive coal from the mill and combust it in the furnace; and where at least one flow control device is in fluid communication with the mill and with the vapor burners; and where at least one flow control device is in fluid communication with the mill and with the main burners; and where the flow control device that is in fluid communication with mill and with the vapor burners is closed to prevent fluid communication between the mill and the furnace during the operation of the furnace.

DETAILED DESCRIPTION

Disclosed herein is a coal fed power plant system that comprises a beater wheel mill for facilitating power generation at loads that are about 25% to 33% below present low load operation levels. Presently the average controlled load operation range for a beater wheel mill is between 50 to 100%. With the disclosed system, the average controlled load operation range for a beater wheel mill is between about 25 to 100%. This system enables a coal fed power plant to be used in conjunction with cogenerating wind and/or solar power plants. The system enables the coal fed power plant to operate under low load conditions so that it can accommodate high power generation in allied wind and/or solar power plants. The system can be advantageous used in beater wheel mills, beater mills, common impact mills, bowl mills and ball tube mills. The system can be advantageous used for the mentioned mill types with or without classifier and more than one burner nozzle. The system is also advantageous in that it can be used as a retrofit, i.e., it can be used to modify an existing coal fed power plant system.

Disclosed herein too is a method of operating the coal fed power plant system that comprises a beater wheel mill. The method comprises reducing the amount of gas from the beater wheel mill that is discharged to the burners. This is accomplished by the shutting of ducts to the burners (e.g. to vapor burners) and by increasing internal gas recirculation to secure a deposit-free operation and ensuring operation at a desirable maximum mill temperature. Reducing the amount of gas from the beater wheel mill to the burners of the furnace reduces the gas flow rate to the mill and consequently reduces the minimum dust loading on the burner at a reduced coal throughput. Reducing the amount of gas from the beater wheel mill to the burners of the furnace can also be accomplished by reducing the number of perfused pulverized fuel ducts for stable and deposit free pulverized fuel transport to the burners, while securing a desired velocity ratio. The velocity ratio is the ratio between the velocity of gas from the mill to a burner to the velocity of secondary air on the burner nozzle. It is desirable for the velocity ratio to be greater than 1. The velocity ratio should be such that a ratio between carbon concentration in the gas from the mill to the secondary air flow is in a range of stable ignition and combustion with a minimum level about 80 grams of carbon per cubic meter of oxygen.

Figure 1:
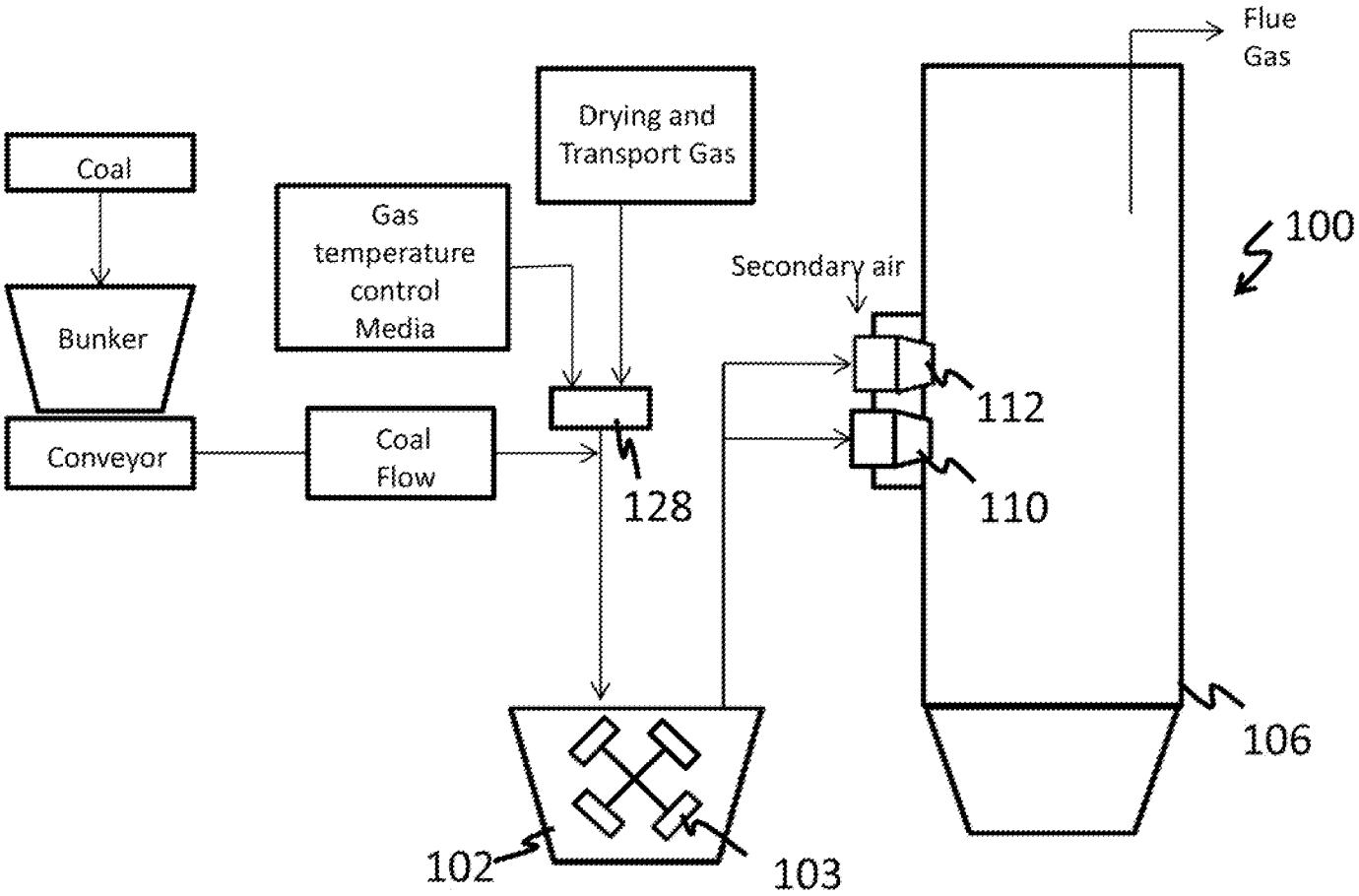
Figure 1 (Prior Art)
FIG. 1 is a prior art depiction of a general coal mill in a power plant that uses a direct firing system.
Figure 2:
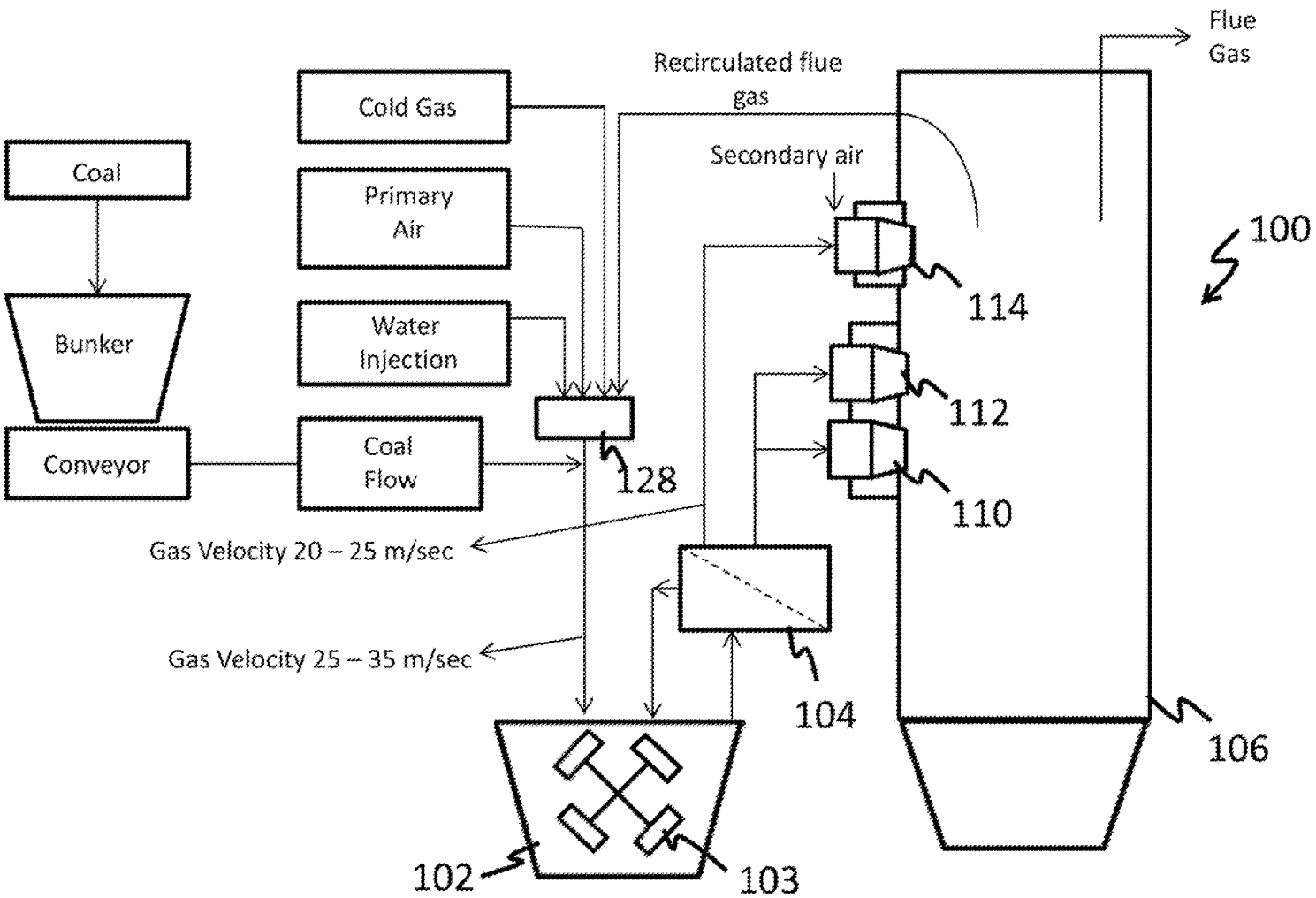
Figure 2 (Prior Art)
FIG. 2 is a another prior art depiction of a general coal mill in a power plant that uses a direct firing system.
Figure 3:
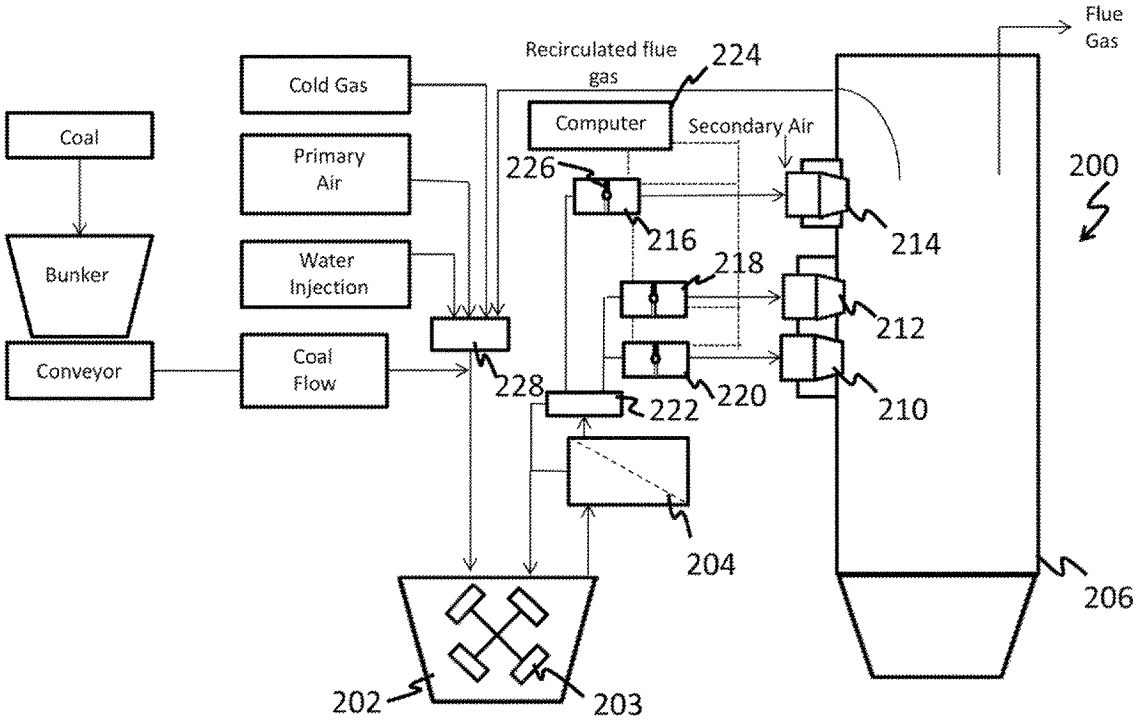
FIG. 3 is a depiction of a modified coal mill in a power plant that facilitates power generation at load levels that are lower than normal.

The FIG. 3 shows a modified coal fed power plant system 200 (hereinafter the "system") that comprises a beater wheel mill 202 for facilitating power generation at loads that are 25% to 33% below present low load operation levels. The beater wheel mill 202 is in fluid communication with a furnace 206. Coal is charged to the beater wheel mill 202 where it is dried as detailed above and then discharged to burners 210, 212 and 214 where it is combusted in a furnace 206.

The coal along with flue gas, water, cold gas and primary air are charged to a wheel beater mill 202 to pulverize the coal. The flue gas, water, cold gas and primary air are mixed in a mixing chamber 228 prior to being discharged to the beater wheel mill 202. The beater wheel mill 202 is in fluid communication with a classifier 204, which functions to separate coal particles above a certain size from other coal particles that are transferred to the furnace 206. The coal particles above the desired size are recycled to the mill to undergo further pulverization. In the beater wheel mill 202, the incoming coal is caught by the rapidly circulating beater plates 203 which are fixed at the perimeter of a beater wheel and comminuted by the impact of the beater plates and after that against the armored mill housing. The modification to the system 200 includes the use a flow control device 216, 218 and 220 inline to the vapor burner 214, the main burners 212 and 210 respectively. Each flow control device includes a flap 226 that can be controlled manually or automatically via a controlling device such as a computer 224. A second modification to the system 200 includes a recirculator 222 that recirculates gases from the classifier 204 back to the beater wheel mill 202.

In one embodiment, the first flow control device 216 containing flap 226 is disposed inline between the classifier 204 and the vapor burner 214. It is disposed downstream of the classifier 204 and upstream of the vapor burner 214. The second flow control device 218 is disposed between the classifier 204 and the main burner 212, while the third flow control device 220 is disposed between the classifier 204 and the main burner 210 respectively. The flow control devices 218 and 220 are disposed downstream of the classifier 204 and upstream of the burners 212 and 210 respectively.

In one embodiment, in order to accommodate lower loads on the coal fed power plant system, the flap 226 of the flow control device 216 is closed, thus closing the duct to the vapor burner 214. As a result of this closing of the duct to the vapor burner 214, the amount of gas flow to the vapor burner is reduced to 0%. The remaining gas flow is therefore directed to the main burners 212 and 210. The flaps 226 in the flow control devices 218 and 220 that supply the gas and coal to the main burners 212 and 210 may also be adjusted to influence coal distribution to the burners. In one embodiment, at least one of the ducts to one of the main burners 212 and 210 may also be closed. Closing the ducts increases the transport speed thus reducing the duct clogging. By trimming the control flow device for the main burners, the individual conduits permit a targeted fuel concentration to the downstream burner. This reduction in the number of fuel ducts by closing flaps 226 is used for transporting a stable and deposit free stream of pulverized fuel transport to the burners. By adjusting the flaps to both the main burners or by completely closing at least one of the flaps to one or more of the main burners, a desired velocity ratio and pulse (momentum of coal particles) can be attained. Attaining the desired velocity ratio and pulse prevents clogging of the ducts and also transfers the coal and associated gases well into the interior of the furnace where they can be efficiently combusted.

In another embodiment, recirculation of the gas by means of a recirculator 222 can be used to increase gas recirculation to secure a deposit free beater wheel mill operation. The recirculation of gases also allows for a lower operating temperature of the beater wheel mill 202 thus preventing explosion hazards. This is because the recirculated gases are at a lower temperature than the temperature of gases in the mill 202. The recirculator is located downstream of the classifier 204. In one embodiment, the recirculator 222 comprises a three-way valve that can be adjusted to vary the amount of gas and coal that is recirculated back to the mill 202. In another embodiment, the recirculator 222 comprises a recirculation damper that can be adjusted to vary the amount of gas and coal that is recirculated back to the mill 202. By varying the amount of gas that is recirculated, the mill can be operated at the maximum safe temperature possible. Minimum velocity ratios can also be maintained in the mill spiral (not shown). In one embodiment, the recirculator 222 can be a part of the classifier 204 and can be used in mills 202 without the classifier 204. In another embodiment, the recirculator is not a part of the classifier 204.

In one embodiment, the amount of gas recirculated is about 5 to about 25 weight percent, of the total weight of gas that is supplied to the main burner.

In one embodiment, the flow control devices 216, 218 and 220 as well as the recirculator 222 are in electrical communication with a computer 224. A feedback loop between the furnace and the flow control devices as well as the recirculator can be used to control the performance of the mill 202. The computer can be used to adjust the position of the flaps 226 within the flow control devices 216, 218 and 220. The computer can also have a database which stores data regarding the type of coal used and can automatically adjust the positions of the flow control devices and the recirculator based upon the type of coal used.

The system is advantageous in that it can be used in a retrofit modification of a coal fed power plant system. The modification permits a reduction of the current low load operation by about 25% to about 33%.

It will be understood that the term "electrical communication" encompasses wireless communication via electromagnetic waves.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region,"

"layer" or "section" discussed below could be termed a second element, component, region, layer or section without departing from the teachings herein.

The terminology used herein is for the purpose of describing particular embodiments only and is not intended to be limiting. As used herein, singular forms like "a," or "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

The term and/or is used herein to mean both "and" as well as "or". For example, "A and/or B" is construed to mean A, B or A and B.

The transition term "comprising" is inclusive of the transition terms "consisting essentially of" and "consisting of" and can be interchanged for "comprising".

While this disclosure describes exemplary embodiments, it will be understood by those skilled in the art that various changes can be made and equivalents can be substituted for elements thereof without departing from the scope of the disclosed embodiments. In addition, many modifications can be made to adapt a particular situation or material to the teachings of this disclosure without departing from the essential scope thereof. Therefore, it is intended that this disclosure not be limited to the particular embodiment disclosed as the best mode contemplated for carrying out this disclosure.

What is claimed is:

1. A coal fed power generation system comprising:

a mill in fluid communication with a furnace; wherein the mill is operative to pulverize coal and to ventilate the coal; the furnace comprising more than one burner or burner nozzles operative to receive the coal from the mill and combust it in the furnace; and a plurality of flow control devices including a first and a second flow control device in fluid communication with the mill and with a respective first and second burner or burner nozzle;

wherein the first flow control device may be closed to prevent fluid communication between the mill and the furnace during the operation of the furnace;

a classifier disposed downstream of the mill and upstream of the furnace, in fluid communication with the mill and the furnace, operative to separate coal particles of a given size from a remainder of the coal particles of the pulverized coal;

a recirculator disposed downstream of the classifier, and separate from the classifier, and operative to recirculate back to the mill gas and coal particles that have passed the classifier; and a computer and a database in electrical communication with the flow control devices and the recirculator, the computer being configured to control the recirculator to adjust an amount of the gas that is recirculated to the mill after having passed the classifier;

wherein the computer is configured to automatically adjust the flow control devices and the recirculator in dependence upon the type of coal used in the mill and furnace.

2. The system of claim 1, wherein the first burner or burner nozzles is a vapor burner and the second burner or burner nozzle is a main burner, and wherein a closing of the first flow control device to the vapor burner promotes increased transport speed of coal and gas through the main burner.

3. The system of claim 1, where the flow control devices are installed as a retrofit to an existing system.

4. The system of claim 1, wherein the recirculator recirculates more than 5 weight percent of gas back to the mill.

5. The system of claim 4, where the recirculating gas cools the mill.

6. The system of claim 1, where the coal fed power generation system is in electrical communication with a wind power generation system.

7. The system of claim 6, where the coal fed power generation system operates at a lower load when in electrical communication with a wind power veneration system as compared with a coal fed power generation system that is not in communication with a wind power generation system.

8. The system of claim 1, where the coal fed power veneration system is in electrical communication with a solar power generation system.

9. The system of claim 8, where the coal fed power generation system operates at a lower load when in electrical communication with a solar power generation system as compared with a coal fed power generation system that is not in communication with a solar power generation system.

10. The system of claim 1, where the low load operation is reduced by more than 25% as compared with a similar coal fed power generation system that does not contain the flow control devices or does not contain a recirculator.

11. The system of claim 1, where the average controlled load operation range for the coal fed power generation system is between 5 to 100%.

12. The system of claim 1, where the mill is one of a beater wheel mill, a beater mill, a common impact mill, a bowl mill, or a ball tube mill.

13. A method comprising:

pulverizing coal in the presence of a mixture of hot flue gases and cold gas in a mill;

discharging the pulverized coal and the mixture of hot flue gases and cold gas, from the mill to a classifier;

separating with the classifier, coal particles of a given size front a remainder of the coal particles;

discharging the pulverized coal and the mixture of hot flue gases and cold gas-from the classifier to a recirculator that is downstream and separate from the classifier;

transferring with a recirculator, a first portion of the pulverized coal and the mixture of hot flue gases and cold gas to one or more burners for combusting in the furnace;

transferring, with the recirculator, a second portion of the pulverized coal and the mixture of hot flue gases and cold gas back to the mill;

adjusting the amount of coal transferred to the one or more burners and transferred back to the mill with at least one flow control device associated with the one or more burners; and with a computer in electrical communication with the recirculator, controlling the recirculator to vary an amount of the hot flue gases and the cold gas recirculated back to the mill and adjusting the flow control devices and the recirculator in dependence upon the type of coal used in the mill and furnace.

14. The method of claim 13, further comprising reducing the temperature of the hot flue gas from over 1000° C. to about 400° C. prior to contacting the pulverized coal.

15. The method of claim 13, further comprising reducing the temperature of the pulverized coal and the mixture of hot flue gases and cold gas from about 120° C. to about 200° C. after being discharged from the mill.

16. A coal fed power generation system comprising:

a mill in fluid communication with a furnace; wherein the mill is operative to pulverize coal and to ventilate the coal; the furnace comprising more than one burner or burner nozzles operative to receive the coal from the mill and combust it in the furnace; and a plurality of flow control devices; including a first and a second flow control device in fluid communication with the mill and with a respective first and second burner or burner nozzle;

wherein the first flow control device may be closed to prevent fluid communication between the mill and the furnace during the operation of the furnace;

a classifier disposed downstream of the mill and upstream of the furnace, in fluid communication with the mill and the furnace, operative to separate coal particles of a given size from a remainder of the coal particles of the pulverized coal;

a recirculator disposed downstream of the classifier, and separate from the classifier, and operative to recirculate back to the mill gas and coal particles that have passed the classifier; and a computer and a database in electrical communication with the flow control devices and the recirculator, the computer being configured to control the recirculator to adjust an amount of the gas that is recirculated to the mill after having passed the classifier;

wherein the recirculator includes one of a damper and a three way valve that is controllable by the computer to vary the amount of the gas and coal particles recirculated back to the mill.

17. The system of claim 16, wherein the first burner or burner nozzles is a vapor burner and the second burner or burner nozzle is a main burner, and wherein a closing of the first flow control device to the vapor burner promotes increased transport speed of coal and gas through the main burner.

18. The system of claim 16, wherein the flow control devices are installed as a retrofit to an existing system.

19. The system of claim 16, wherein the coal fed power generation system is in electrical communication with at least one of a wind power generation system and a solar power generation system.

* * * * *